United States Patent [19]

Isozumi

[11] Patent Number: 4,760,274

[45] Date of Patent: Jul. 26, 1988

[54] COAXIAL TYPE STARTER DEVICE

[75] Inventor: Shuzo Isozumi, Himeji, Japan

[73] Assignee: Mitsubishi Denki Kabushiki Kaisha, Tokyo, Japan

[21] Appl. No.: 116,691

[22] Filed: Nov. 4, 1987

[30] Foreign Application Priority Data

Nov. 4, 1986 [JP] Japan ..... 61-262393

[51] Int. Cl.[4] ..... F02N 15/06

[52] U.S. Cl. ..... 290/48; 74/7 A; 74/7 E

[58] Field of Search ..... 290/48; 74/7 A, 7 C, 74/7 E; 123/179 R

[56] References Cited

U.S. PATENT DOCUMENTS 3,851,532 12/1974 Pfluger et al. ..... 74/7 A
4,327,300 4/1982 Hoven ..... 310/75 C
4,587,861 5/1986 Morishita ..... 74/7 E
4,592,243 6/1986 Katoh et al. ..... 74/7 E
4,604,907 8/1986 Morishita et al. ..... 74/7 E
4,671,125 6/1987 Yabunaka ..... 290/48 X

*Primary Examiner*—William M. Shoop, Jr.
*Assistant Examiner*—W. E. Duncanson, Jr.
*Attorney, Agent, or Firm*—Oblon, Fisher, Spivak, McClelland & Maier

[57] ABSTRACT

The coaxial type starter device of the present invention has a hollow rotary shaft of the armature of the d.c. motor. A rod is slidably inserted in the armature rotary shaft in its axial direction. One end of the rod is connected to a solenoid-operated switch device and the other end is adapted to push a output rotary shaft.

A thick-walled portion is formed in the hollow armature rotary shaft so as to extend from the inner wall in the radial direction so that the thick-walled portion directly supports the rod or indirectly supports the rod through a sleeve bearing.

6 Claims, 3 Drawing Sheets

COAXIAL TYPE STARTER DEVICE

BACKGROUD OF THE INVENITON

1. Field of the Invention

The present invention relates to a coaxial type starter device. More particularly, it relates to a coaxial type starter used for starting the engine of an automobile.

2. Discussion of Background

FIG. 3 shows the construction of a conventional starter device used for starting the engine of a car.

The conventional starter device 1 comprises a d.c. motor, an overrunning clutch 4 slidably fitted on a rotary output shaft 3, a gear wheel device 5 for reducing the revolution of the armature rotary shaft 2*a* of the d.c. motor 2 so that a rotating force by the rotary shaft 2*a* is transmitted to a clutch outer member 4*a* in the overrunning clutch 4 through the rotary output shaft 3, a solenoid-operated switch device 6 disposed at a side of the d.c. motor 2 to let the overrunning clutch 4 slide on the rotary output shaft 3 and a shift lever 8 which has an end connected to the plunger rod of the solenoid-operated switch device 6 and the other end engaged with an annuler member 7 attached to the overrunning clutch 4.

In the conventional starter device 1, however, the shift lever 8 was required to cause the overrunning clutch 4 to slide on the output rotary shaft 3. Further, since the solenoid-operated switch device 6 which operates the shift lever 8 to electrically connect the d.c. motor 2 to a power source is placed at a side of the d.c. motor 2 to thereby assume a so-called double-axle structure, there was a great limitation in arrangement when an engine for a car is to be designed.

To solve the above-mentioned problem, there is a proposal to render the starter device to have a simple configuration such as an enlongated cylindrical form by disposing the solenoid-operated switch device at one side in the axial direction of the d.c. motor. The proposed starter device has such a basic construction that there is provided a hollow armature rotary shaft in the d.c. motor, and a plunger rod of the solenoid-operated switch device used for operating a shift lever is extended to a rotary output shaft through the inner bore of the armature rotary shaft. The above-mentioned starter device is referred to a coaxial type starter device from the fact that the armature rotary shaft of the d.c. motor is arranged in the same axial line as the rod of the solenoid-operated switch device.

However, the proposed coaxial type starter device has a drawback as follows. Namely, when the outer circumferential surface of the armature rotary shaft having a hollowed cylindrical shape is machined, a large external force is applied to the hollowed cylidrical body. Further, a large force is applied to that portion when an armature core is forcibly fitted. Such large external force may cause deformatrion in the shape of the hollow armature rotary shaft. In addition, it is very difficult to support the plunger rod extending from the solenoid-operated switch device because the major part of the plunger rod is in the inner passage of the hollow armature rotary shaft.

SUMMARY OF THE INVENTION

It is an object of the present invention to provide a coaxial type starter device which aviods deformation of the armature rotary shaft at the position where the armature core is fitted and which supports a rod extending from a solenoid-operated switch device to be inserted in the armature rotary shaft.

The foregoing and the other objects of the present invention have been attained by providing a coaxial type starter device which comprises a d.c. motor having a hollow rotary shaft on which an armature is mounted; a rotary output shaft placed in the same axial line as the armature rotary shaft at one side of the d.c. motor so as to be slidable along the axial line; an overrunning clutch for transmitting a rotating force produced by the armature rotary shaft to the rotary output shaft; a solenoid-operated switch device placed at the other side of the d.c. motor; and a rod extending from the solenoid-operated switch device and passing through the hollow portion of the armature rotary shaft to be in contact with an end of the rotary output shaft, the rod being movable along its axial direction by an electromagnetic force given by the solenoid-operated switch device, wherein a thick-walled portion is formed at an armature core fitting part of the armature rotary shaft so that it radially extends from the inner wall of the hollow portion of the armature rotary shaft to form a small diameter portion in which the rod is inserted with a slight gap between the outer circumference of the rod and the inner wall of the thick-walled portion.

Further, the present invention is to provide a coaxial type starter device which comprises a d.c. motor having a hollow rotary shaft on which an armature is mounted; a rotary output shaft placed in the same axial line as the armature rotary shaft at one side of the d.c. motor so as to be slidable along the axial line; an overrunning clutch for transmitting a rotating force produced by the armature rotary shaft to the rotary output shaft; a solenoid-operated switch device placed at the other side of the d.c. motor; a rod extending from the solenoid-operated switch device and passing through the hollow portion of the armature rotary shaft to be in contact with an end of the rotary output shaft, the rod being movable along its axial direction by an electromagnetic force given by the solenoid-operated switch device; a thick-walled portion formed at an armature core fitting part of the armature rotary shaft so as to radially extend from the inner wall of the hollow portion of the armature rotary shaft, and a sleeve bearing fitted to the inner wall of the thick-walled portion to support the rod slidably.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the present invention will be described with reference to the drawings.

Figure 1:
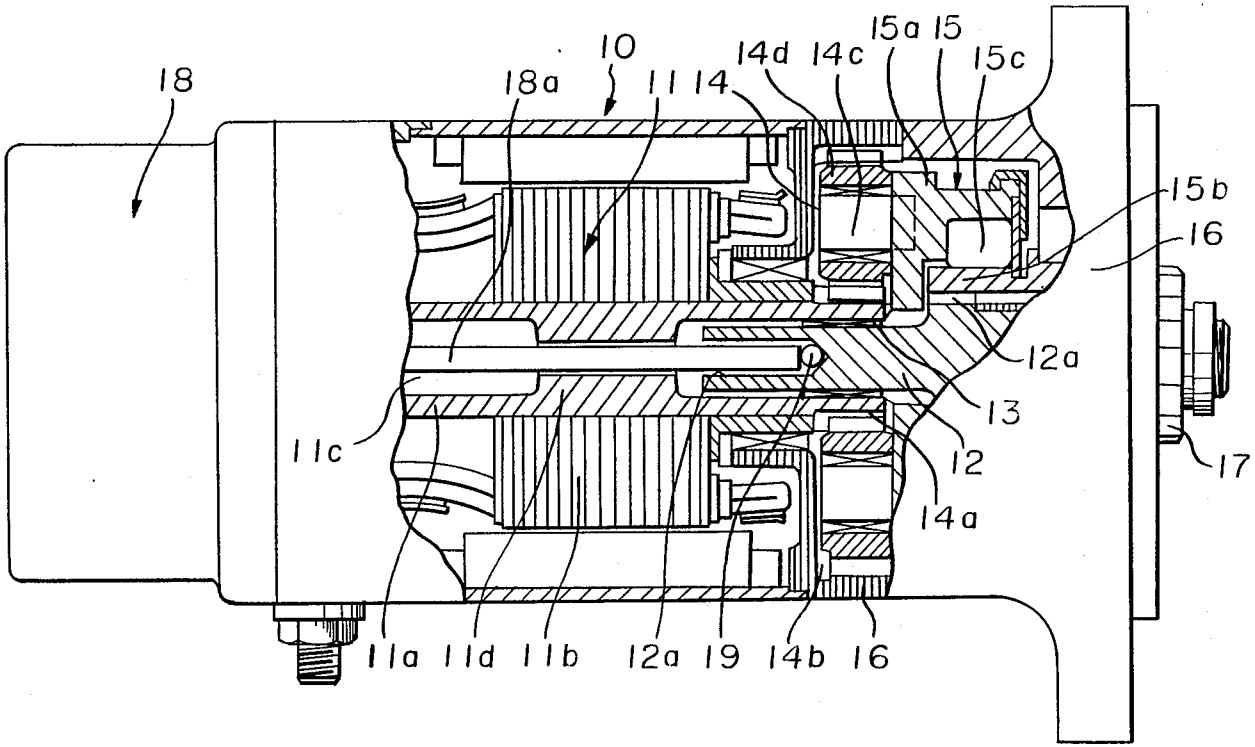
FIG. 1 is a front view partly broken of an embodiment of the coaxial type starter device according to the present invention.

In FIG. 1, there is shown a coaxial type starter device 10 according to an embodiment of the present invention. The starter device 10 is provided with a d.c motor 11 having an armature rotary shaft 11*a* of a tubular form. An armature core 11*b* is press-fitted on the outer circumferential surface of the hollow armature rotary shaft. A rotary output shaft 12 is placed at one side in the axial direction (on the right hand in FIG. 1) of the d.c. motor 11 in alignment with the axial line of the armature rotary shaft 11*a*. The rotary output shaft 12 has an end inserted in an inner passage 11*c* in the armature rotary shaft 11*a* and is slidably held in the axial direction by means of a sleeve bearing 13 interposed between the outer circumference of the rotary output shaft 12 and the inner wall of the hollow armature rotary shaft 11*a*.

A rotating force produced by the armature rotary shaft 11*a* is transmitted to the rotary output shaft 12 by means of a planet gear device 14 and an overrunning clutch 15. Namely, the planet gear device 14 comprises a sun gear 14*a* formed integrally with the outer circumferential portion of an end of the armature rotary shaft 11*a*, an internal gear 14*b* formed in the inner circumferential surface of the frame of the starter device surrounding the sun gear 14*a*, and a plurality of planet gears 14*d* which interlock with both the sun gear 14*a* and the internal gear 14*b* and which are supported in a rotatable manner by a central supporting shaft 14*c* fixed to the clutch outer member 15*a* of the overrunning clutch 15. The clutch inner member 15*b* of the overrunning clutch 15 is interlocked with a helical spline 12*a* formed at the outer circumferential surface of the rotary output shaft 12, whereby the rotary output shaft 12 is slidable in its axial direction, while it is driven by the clutch inner member 15*b*. A pinion 17 is firmly attached to the other end of the rotary output shaft 12 extending from the machine frame 16, the pinion 17 being adapted to be interlocked with a ring gear of the engine.

A solenoid-operated switch device 18 is placed at the other side (on the left hand in FIG. 1) of the d.c. motor 11. The solenoid-operated switch device 18 is operable in the same manner as that of the conventional starter device. Namely, the solenoid-operated switch device 18 is actuated by the operation of a key switch for the car so that the rod is moved by an electromagnetic force produced by a solenoid. The movement of the rod causes the pinion to interlock with the ring gear of the engine and at the same time, a power is supplied to the d.c. motor.

In the coaxial type starter device of the present invention, a mechanism for causing the engagement of the pinion with the ring gear by the movement of the rod of the solenoid-operated switch device is as follows.

The rod 18*a* extending from the solenoid-operated switch device 18 is in alignment with the axial line of the armature rotary shaft 11*a* of the d.c. motor 11 and is inserted in the inner passage 11*c* of the armature rotary shaft 11*a* so that the free end of the rod 18*a* is in contact with the bottom of a recess 12*a* formed in the one end of the rotary output shaft 12 through a steel ball 19.

The inner diameter of the inner passage 11*c* of the armature rotary shaft 11*a* is made far greater than the outer diameter of the rod 18*a*. It is because the inner passage 11*c* receives one end of the rotary output shaft 12 at its one side and various structural elements of the solenoid-operated switch device 18 are placed in the inner passage 11*c* at the other side. The armature rotary shaft 11*a* is provided with a thick-walled portion 11*d* which inwardly extends in the radial direction from the inner circumferential wall of the inner passage 11*c* at the armature core fitting part of the armature rotary shaft 11*a*. The thick-walled portion 11*d* should be thick as possible so that a slight gap is formed between the inner circumferential surface of the radially extending thick-walled portion 11*d* and the outer circumferential surface of the rod 11*a*. The thick-walled portion 11*d* acts as a reinforcing member and prevents deformation of the hollow armature rotary shaft 11*a* caused when the armature core 11*b* is press-fitted.

The operation of the starter device of the above-mentioned embodiment will be described. On closing the starter switch, an exciting coil in the solenoid-operated switch device 18 is excited to produce an electromagnetic force to thereby move the rod 18*a* on the right hand along the axial direciton in FIG. 1. As a result, the rotary output shaft 12 is pushed, whereby the pinion 17 attached to the other end of the output shaft 12 is interlocked with the ring gear of the engine. At the same time, the movement of the rod 18*a* brings a movable contact (not shown) into contact with a stationary contact (not shown). Then, a power is supplied to the d.c. motor 11 so that the motor 11 is actuated. Then, the revolution speed of the armature rotary shaft 11*a* is reduced by the planet gear device 14, and a torque in a reduced speed is transmitted to the clutch outer member 15*a* of the overrunning clutch 15. The revolution of the clutch outer member 15*a* is transmitted to the clutch inner member 15*b* through a cylindrical rollers 15*c*. The revolution of the clutch inner member 15*b* is transmitted to the rotary output shaft 12 through the herical spline 12*a*, whereby the pinion 17 is rotated to start the engine.

The overrunning clutch 15 prevents the rotary output shaft 12 to be reversely driven after the engine is started. The rotary output shaft 12 and the rod 18*a* of the solenoid-operated switch device 18 are returned to the original position by means of a return spring provided at a suitable position in the starter device.

Figure 2:
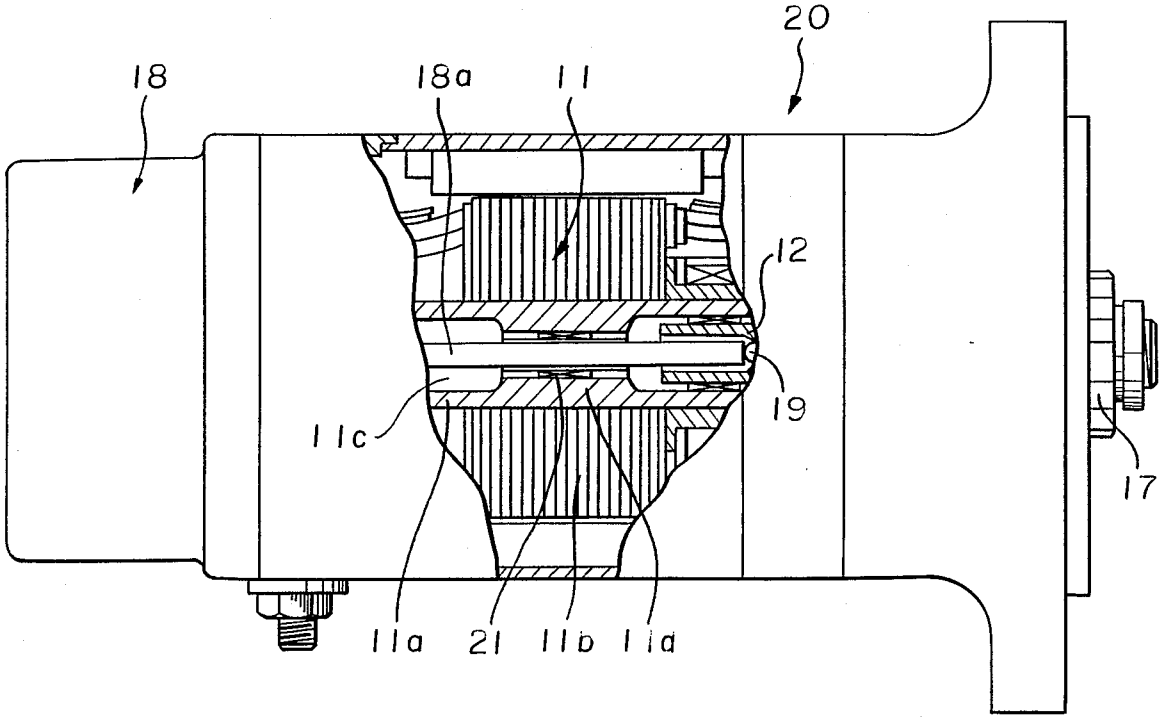
FIG. 2 is a front view partly broken of another embodiment of the coaxial type starter device of the present invention.
Figure 3:
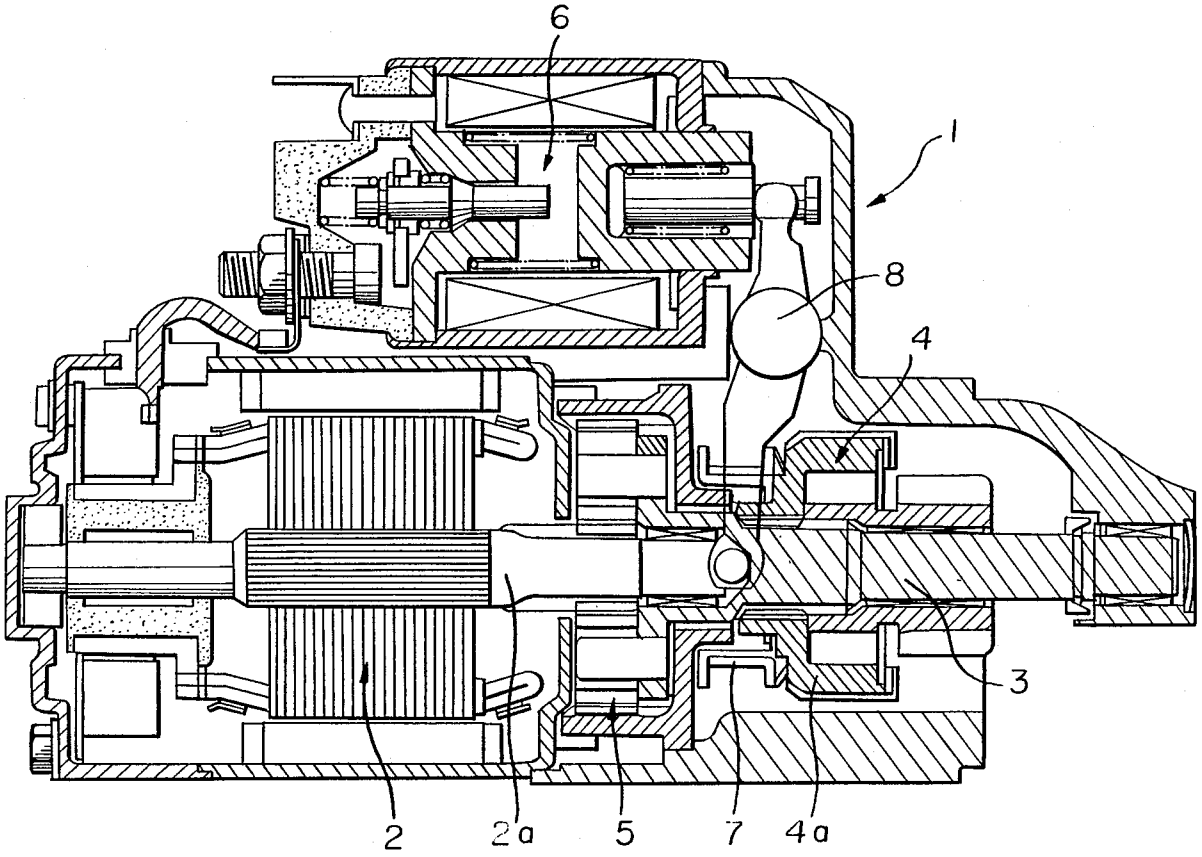
FIG. 3 is a longitudinal cross-sectional view of a conventional double-axle type starter device.

FIG. 2 shows another embodiment of the coaxial type starter device of the present invention. In FIG. 2, the same reference nemerals designate the same or corresponding parts. In the coaxial type starter device 20 according to the second embodiment of the present invention, the armature rotary shaft 11*a* having a hollow portion has the thick-walled portion 11*d* which is formed at the armature core fitting part of the armature rotary shaft so as to radially extend inwardly from the inner circumferential surface of the inner passage 11*c*. A sleeve bearing 21 is fitted between the inner circumferential surface of the thick-walled portion 11*d* and the outer circumferential surface of the rod 11*a* so that the rod 18*a* extending from the solenoid-operated switch device 18 is slidably supported.

In the second embodiment of the present invention, the armature core fitting part of the hollow armature rotary shaft 11*a* is substatially solid from the fact that the rod 18*a* is slidably supported by the sleeve bearing 21 between the inner circumferential surface of thick-walled portion 11*d* and the outer circumferential surface of the rod 18, with the result that rigidity of the hollow armature rotary shaft is remarkably increased and deformation of the armature rotary shaft can be eliminated. Further, there causes no flexure of the rod because it is supported by the sleeve bearing in the armature rotary shaft. The construction of the embodiment prevents dust or the other foreign substances from entering into the solenoid-operated switch device from the side of the rotary output shaft through the inner passage of the armature rotary shaft.

As described above, the coaxial type starter device of the present invention is so constructed that the solenoid-operated switch device is placed at one side in the axial direction of the d.c. motor; the movable rod extending from the solenoid-operated switch device is extended through the armature rotary shaft to be in contact with an end of the rotary output shaft so that the rotaty output shaft is directly pushed by the rod. Accordingly, loss in kinetic energy at each of the structural elements is small, and the shape of the starter device can be simple. Therefore, there is a great allowability in designing a car engine. Further, deformation of the armature rotary shaft is avoidable since the hollow armature rotary shaft has a thick-walled portion at the armature core fitting part through which the rod of the solenoid-operated switch device is inserted.

Besides the armature rotary shaft having the thick-walled portion, the sleeve bearing is fitted to the thick-walled portion to slidably support the rod. Accordingly, the armature core fitting part of the rotary shaft is substantially solid to thereby remarkably increase rigidity and deformation of the armature rotary shaft can be prevented.

Obviously, numerous modifications and variations of the present invention are possible in light of the above teachings. It is therefore to be understood that within the scope of the appended claims, the invention may be practiced otherwise than as specifically described herein.

What is claimed is:

1. A coaxial type starter device which comprises:
- a d.c. motor having a hollow rotary shaft on which an armature is mounted;
- a rotary output shaft placed in the same axial line as said armature rotary shaft at one side of said d.c. motor so as to be slidable along said axial line;
- an overrunning clutch for transmitting a rotating force produced by said armature rotary shaft to said rotary output shaft;
- a solenoid-operated switch device placed at the other side of said d.c. motor; and
- a rod extending from said solenoid-operated switch device and passing through the hollow portion of said armature rotary shaft to be in contact with an end of said rotary output shaft, said rod being movable along its axial direction by an electromagnetic force given by said solenoid-operated switch device, wherein a thick-walled portion is formed at an armature core fitting part of said armature rotary shaft so that it radially extends from the inner wall of the hollow portion of said armature rotary shaft to form a small diameter portion in which said rod is inserted with a slight gap between the outer circumference of the rod and the inner wall of said thick-walled portion.

2. The coaxial type starter device according to claim 1, wherein said thick-walled portion forms a cylindrical hollow.

3. The coaxial type starter device according to claim 1, wherein one end of said rotary output shaft is provided with a recess depressed along its axial direction; a free end of said rod extending from said solenoid-operated switch device is inserted in said recess to push said rotary output shaft through a ball bearing, and the end of said rotary output shaft at opposite side of a pinion extends in a hollow portion of said armature rotary shaft.

4. A coaxial type starter device which comprises:
- a d.c. motor having a hollow rotary shaft on which an armature is mounted;
- a rotary output shaft placed in the same axial line as said armature rotary shaft at one side of said d.c. motor so as to be slidable along said axial line;
- an overrunning clutch for transmitting a rotating force produced by said armature rotary shaft to said rotary output shaft;
- a solenoid-operated switch device placed at the other side of said d.c. motor;
- a rod extending from said solenoid-operated switch device and passing through the hollow portion of said armature rotary shaft to be in contact with an end of said rotary output shaft, said rod being movable along its axial direction by an electromagnetic force given by said solenoid-operated switch device;
- a thick-walled portion formed at an armature core fitting part of said armature rotary shaft so as to radially extend from the inner wall of the hollow portion of said armature rotary shaft, and
- a sleeve bearing fitted to the inner wall of said thick-walled portion to support said rod slidably.

5. The coaxial type satrter device according to claim 4, wherein said thick-walled portion forms a cylindrical hollow.

6. The coaxial type starter device according to claim 4, wherein one end of said rotary output shaft is provided with a recess depressed along its axial direction; a free end of said rod extending from said solenoid-operated switch device is inserted in said recess to push said rotary output shaft through a ball bearing, and the end of said rotary output shaft at opposite side of a pinion extends in a hollow portion of said armature rotary shaft.

* * * * *